US012392140B2

(12) United States Patent
Boucké

(10) Patent No.: US 12,392,140 B2
(45) Date of Patent: Aug. 19, 2025

(54) PANEL AND COVERING

(71) Applicant: I4F Licensing NV, Turnhout (BE)

(72) Inventor: Eddy Alberic Boucké, Menen (BE)

(73) Assignee: i4F Licensing NV, Turnhout (BE)

( * ) Notice: Subject to any disclaimer, the term of this patent is extended or adjusted under 35 U.S.C. 154(b) by 68 days.

(21) Appl. No.: 18/018,699

(22) PCT Filed: Jul. 27, 2021

(86) PCT No.: PCT/EP2021/070967
§ 371 (c)(1),
(2) Date: Jan. 30, 2023

(87) PCT Pub. No.: WO2022/023320
PCT Pub. Date: Feb. 3, 2022

(65) Prior Publication Data

US 2023/0304299 A1 Sep. 28, 2023

(30) Foreign Application Priority Data

| | | |
|---|---|---|
| Jul. 31, 2020 | (NL) | 2026188 |
| Jul. 31, 2020 | (NL) | 2026191 |
| Sep. 28, 2020 | (NL) | 2026559 |
| Jul. 23, 2021 | (WO) | PCT/EP2021/070758 |

(51) Int. Cl.
*E04F 15/02* (2006.01)

(52) U.S. Cl.
CPC ..... *E04F 15/02038* (2013.01); *E04F 2201/0146* (2013.01)

(58) Field of Classification Search
CPC ..... E04F 15/02038; E04F 12/10; E04F 2201/0146; E04F 2201/023; E04F 15/02
See application file for complete search history.

(56) References Cited

U.S. PATENT DOCUMENTS

| | | | | |
|---|---|---|---|---|
| 9,574,354 | B2 | 2/2017 | Stevens, Jr. | |
| 9,885,187 | B2 * | 2/2018 | Kell | E04F 15/02033 |
| 11,208,814 | B2 | 12/2021 | De Rick | |
| 11,225,800 | B2 | 1/2022 | De Rick et al. | |
| 11,377,856 | B2 | 7/2022 | Boucke | |
| 2004/0128934 | A1 * | 7/2004 | Hecht | E04F 15/02 52/578 |
| 2017/0067261 | A1 | 3/2017 | Hannig et al. | |
| 2017/0284105 | A1 * | 10/2017 | Ceysson | E04F 15/105 |
| 2018/0094441 | A1 | 4/2018 | Boo | |
| 2019/0017278 | A1 * | 1/2019 | De Rick | E04F 15/105 |

(Continued)

FOREIGN PATENT DOCUMENTS

| | | | |
|---|---|---|---|
| DE | 102005012827 | B3 | 7/2006 |
| EP | 3597836 | A1 | 1/2020 |
| WO | 2014033628 | A1 | 3/2014 |

(Continued)

*Primary Examiner* — Theodore V Adamos
(74) *Attorney, Agent, or Firm* — The Webb Law Firm

(57) ABSTRACT

The last decades has seen enormous advance in the market for flooring for floor covering. It is known to install floor panels on an underlying floor in various ways. The present invention relates to an improved panel, such as a floor panel, in particular a decorative floor panel. The invention also relates to a covering, in particular a floor covering, including multiple interconnected panels according to the invention.

23 Claims, 5 Drawing Sheets

(56) References Cited

U.S. PATENT DOCUMENTS

2020/0232226 A1* 7/2020 De Rick ..... E04F 15/107

FOREIGN PATENT DOCUMENTS

| | | | | | |
|---|---|---|---|---|---|
| WO | 2017115202 | A1 | | 7/2017 | |
| WO | 2019137964 | A1 | | 7/2019 | |
| WO | 2019138365 | A1 | | 7/2019 | |
| WO | WO-2020234711 | A1 | * | 11/2020 | ..... E04F 15/02033 |
| WO | WO-2021111210 | A1 | * | 6/2021 | ..... E04F 15/02038 |

* cited by examiner

PANEL AND COVERING

CROSS-REFERENCE TO RELATED APPLICATIONS

This application is the United States national phase of International Application No. PCT/EP2021/070967 filed Jul. 27, 2021, and claims priority to The Netherlands Patent Application Nos. 2026188 filed Jul. 31, 2020, U.S. Pat. No. 2,026,191 filed Jul. 31, 2020, and U.S. Pat. No. 2,026,559 filed Sep. 28, 2020, and International Application No. PCT/EP2021/070758 filed Jul. 23, 2021, the disclosures of which are hereby incorporated by reference in their entireties.

BACKGROUND OF THE INVENTION

Field of the Invention

The present invention relates to a panel, in particular a floor panel, and a covering, in particular a floor covering, comprising multiple panels according to the invention.

Description of Related Art

The last decades has seen enormous advance in the market for flooring for floor covering. It is known to install floor panels on a underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling, whereby mostly they are glued together in the tongue and groove, too. The floor obtained in this manner, also called a floating parquet flooring, has as an advantage that it is easy to install and that the complete floor surface can move which often is convenient in order to receive possible expansion and shrinkage phenomena. Examples of known floor panels are shown in WO2019/138365, EP3597836, WO2019/137964, and WO2017/115202.

The options and requirements for flooring has evolved as well. Whereas flooring used to be made of wood or wood-derived products, lately the market has evolved towards plastic-based panels, like PVC panels and even towards mineral-based panels, like magnesium-oxide based panels. Each of these alternative has their advantages and disadvantages.

One of the disadvantages is that it can be difficult to couple and lock panels together, and lock them such that a watertight connection is made between the panels.

SUMMARY OF THE INVENTION

It is therefore a goal of the present invention to provide an improved connection between panels, in particular a waterproof connection.

The present invention thereto provides a panel, in particular a floor panel, comprising: at least one first coupling part and at least one second coupling part arranged on opposite sides panel, wherein the first coupling part and the second coupling part of another panel are arranged to be coupled with a downward motion; wherein the first coupling part comprises an upward tongue, at least one upward flank lying at a distance from the upward tongue and an upward groove formed in between the upward tongue and the upward flank, wherein the upward groove is adapted to receive at least a part of a downward tongue of a second coupling part of another panel, wherein the side of the upward tongue facing towards the upward flank is the inside of the upward tongue and the side of the upward tongue facing away from the upward flank is the outside of the upward tongue; wherein the second coupling part comprises a downward tongue, at least one downward flank lying at a distance from the downward tongue, and a downward groove formed in between the downward tongue and the downward flank, wherein the downward groove s adapted to receive at least a part of an upward tongue of a first coupling part of another panel, wherein the side of the downward tongue facing towards the downward flank is the inside of the downward tongue and the side of the downward tongue facing away from the downward flank is the outside of the downward tongue; wherein the outside of the downward tongue and the upward flank both comprise an upper contact surface near or at or adjoining or towards a top side of the panel, which upper contact surfaces are in contact in coupled condition of the panels and, and wherein at least one upper contact surface preferably extends vertically at least partly; wherein the outside of the upward tongue comprises a first locking element in the form of an outward bulge and wherein the downward flank is provided with a second locking element, in the form of a recess, wherein at least a part of the first and at least a part of second locking element are in contact, in coupled condition of the panels and form a locking element surface; wherein the outside of the outward bulge comprises an upper portion and an adjoining lower portion, wherein the lower portion comprises an inclined locking surface and the upper portion comprises a, preferably curved, guiding surface; wherein the recess comprises an upper portion and an adjoining lower portion, wherein the lower portion comprises an inclined locking surface; wherein the parts of the first and second locking element that are in contact, in coupled condition of the panels, are the inclined locking surfaces of the locking elements and/or wherein, in coupled condition of the panels, the upper portions of the first and second locking elements are spaced apart at least partially.

It is noted that in describing the invention terms like top, bottom, upper, lower, horizontal and vertical are used based on a flooring configuration, with the side facing upward being the top or upper side, the side on the subfloor is the bottom or lower side and the panels lie horizontally or in a horizontal plane. When used as wall covering, which is also possible with the panels according to the present invention, the panels are typically mounted vertically. The side facing towards the wall is then the bottom, the side facing towards the room is the top and vertical and horizontal are flipped. The wall panels themselves can also be assessed lying on the floor, as you would lie the panels as floor panels. The same applies to ceiling coverings, which is also possible with the panels according to the present invention, in which the panels are mounted on the ceiling. The top and bottom are then flipped. The ceiling panels themselves can also be assessed lying on the floor, as you would lie the panels as floor panels.

The coupling parts of two panels interact, and provide for a locking of the panels, typically in a horizontal and vertical direction. The upward tongue is placed into the downward groove and the downward tongue is placed into the upward groove, which provides a locking in the plane of the panel, or the horizontal direction for floor coverings for example.

Preferably, at least a part of the inside, and more preferably the entire inside, of the upward tongue is inclined towards the upward flank, and at least a part of the inside, and more preferably the entire inside, of the downward tongue is inclined towards the downward flank. This typically results in the beneficial effect that the upward tongue is at least partially surrounded and secured, and possibly clamped, by the downward groove, and that the downward tongue is at least partially surrounded and secure, and possibly clamped, by the upward groove.

The panels are typically arranged to be coupled with a downward motion. Such motion is also referred to as drop-down or vertical motion, and may mean that a new panel can be pushed into a panel already placed. Such coupling is also possible when panels are connected through a zipping or scissoring motion. Alternatively the panels may be arranged to be coupled with an angling (down) motion. Such motion may also be referred to as rotational motion, wherein a portion of a new panel is inserted into a portion of a panel already placed and fully inserted through an angling motion. In a preferred embodiment, the panel comprises at least one third coupling part and at least one fourth coupling part arranged on another pair of opposite sides of the panel, wherein the third coupling part of said panel and the fourth coupling part of another panel are preferably arranged to be coupled by means of an angling down motion. Preferably, the third coupling part comprises: a sideward tongue extending in a direction substantially parallel to the upper side of the core, at least one second downward flank lying at a distance from the sideward tongue, and a second downward groove formed between the sideward tongue and the second downward flank, and wherein the fourth coupling part comprises: a third groove configured for accommodating at least a part of the sideward tongue of the third coupling profile of an adjacent panel, said third groove being defined by an upper lip and a lower lip, wherein said lower lip is provided with an upward locking element, wherein the third coupling part and the fourth coupling part are configured such that two of such panels can be coupled to each other by means of a turning movement, wherein, in coupled condition: at least a part of the sideward tongue of a first panel is inserted into the third groove of an adjacent, second panel, and wherein at least a part of the upward locking element of said second panel is inserted into the second downward groove of said first panel.

To form a tight connection at the top, the panels are in contact at the upper contact surfaces. Preferably these upper contact surfaces are substantially plane parallel and both contact surfaces may extend vertically, to increase the contact surface. It may is often advantageous that at least one upper contact surface is slightly inclined with respect to a vertical plane, wherein this at least one slightly inclined contact surface and said vertical plane preferably enclose an angle of between 0 and 2 degrees, preferably between 0 and 1 degrees, more preferably between 0 and 0.5 degrees, even more preferably between 0 and 0.3 degrees. Preferably, the upper contact surface of the downward tongue extends in vertical direction, and wherein the upper contact surface of the upward flank is downwardly inclined in a direction away from the upward tongue, wherein, preferably, wherein, more preferably the vertical upper contact surface of the downward tongue and the inclined upper contact surface of the upward flank mutually enclose angle of between 0 and 2 degrees, preferably between 0 and 1 degrees, more preferably between 0 and 0.5 degrees, even more preferably between 0 and 0.3 degrees. It is also imaginable that the upper contact surface of the upward flank extends in vertical direction, and wherein the upper contact surface of the downward tongue is downwardly inclined in a direction towards the downward flank. Preferably, the inclined upper contact surface of the downward tongue and the vertical upper contact surface of the upward flank mutually enclose angle of between 0 and 2 degrees, preferably between 0 and 1 degrees, more preferably between 0 and 0.5 degrees, even more preferably between 0 and 0.3 degrees. It is additionally conceivable that each of the upper contact surface of the downward tongue and the upper contact surface of the upward flank is at least partially inclined with respect to a vertical plane (i.e. a plane perpendicular to the panels). This inclination is preferably such that both that both upper contact surfaces are downwardly inclined away from each other. A technical effect of these embodiments is that at the top seam formed in between the panels a more intense contact between the upper contact surfaces can be realized, which is in favour of creating a watertight barrier. Moreover, the abovementioned inclination typically reduces the sensitivity for tolerances and preciseness during manufacturing and coupling. The slightly inclined upper contact surface prevents the occurrence of a creak in between intercoupled panels. The inclination further allows for a stronger or better connection of coupled panels at the top, where the panels are configured to be in full contact when coupled.

The upper contact surfaces are not necessarily the upper surfaces of the panels, it is for instance possible to provide the panels with a chamfered or bevelled top surface or a grout, which would provide a decorative function at the surface of the panels. Preferably the upper contact surfaces are the upper surfaces where two panels are in contact.

Furthermore in an embodiment, the outside of the downward tongue comprises in between the upper contact surface and the inclined contact surface of the downward tongue at least one, preferably trapezium-shaped, recess is present, wherein, in coupled condition of adjacent panels, said recess is preferably positioned at a distance from the upper contact surface of the upward flank.

Said recess allows for (locally) expanding or swelling of the material of the panel preventing disrupting or dislocating the coupling between two intercoupled panels. The recess also functions as an additional dust chamber preventing dust to interfere with the contact of the upper contact surfaces. The recess may be arranged between the upper contact surface of the downward tongue and an inclined contact surface and/or third locking element of the downward tongue, or at the transition of the upper contact surface and said inclined contact surface and/or said third locking element of the downward tongue.

Preferably the panels, or the coupling parts of the panels, are configured such that they exert a certain locking force in coupled condition, forcing the panels towards each other. Such locking force can for instance be achieved by a pre-tension configuration or by slightly oversizing one coupling part compared to the other. In floor panels this creates a force in horizontal direction, or in the plane of the floor panel. This locking force preferably pushed the panels towards each other in the main plane of the panels, and thus pushes the upper contact surfaces together, wherein this pretension improves the connection between the panels and preferably creating a watertight seal at the top of the panels.

It is conceivable that due to the locking force or clamping force the area or zone at or around the inclined contact surface of the downward tongue is elastically or plastically deformed during engagement of adjacent inclined contact surfaces. The type of extent of deformation typically depends on the material characteristics of the panel and the specific design of the coupling parts.

The outside of the upward tongue comprises a first locking element, for instance in the form of an outward bulge and the downward flank may be provided with a second locking element, for instance in the form of a recess, wherein at least a part of the first and at least a part of second locking element are in contact, in coupled condition of the panels and form a locking element surface. The two locking elements may thus co-act to provide a locking, in particular a locking in vertical direction or perpendicular to the (main) plane of the panels. The first and second locking elements are preferably formed integrally with the panel, and can for instance be milled into the panel material. Applying the mutually co-acting locking elements prevents a substantially vertical displacement of the two panels relative to each other. Either or both the first locking element and the second locking element are preferably connected substantially rigidly to respectively the rest of the panel, such that a relatively durable and strong locking can be realized, since no use is made of relatively weak resilient locking parts in which material fatigue could moreover occur relatively quickly. The first locking element can form an integral part of the upward tongue, wherein the first locking element can for instance be formed by a protruding (outward bulging) or recessed (inward bulging) edge deformation of the upward tongue.

The first locking element may be an outward bulge, wherein the outside of the outward bulge comprises an upper portion and an adjoining lower portion, wherein the lower portion comprises an inclined locking surface and the upper portion comprises a, preferably curved, guiding surface. The first locking element, on the outside of the upward tongue will, during coupling, encounter the downward flank of another panel, as it is the protruding portion of the panel, and typically is the outermost portion of the panel on one side and forces need to be overcome during coupling to force one panel into the other. By providing a (curved) guiding surface on the upper portion, the further or other panel is guided downwards, such that coupling may occur gradually and large material deformations and/or peak stresses can be prevented. The lower portion may thus be inclined, and forms the portion of the bulge which from the outermost part of the bulge returns towards the upward tongue. Also this inclined surface provides a guiding function, guiding the panels towards their final stage. The inclination of the locking surface further allows that a potential upward force or motion of the panels results in a vertical and horizontal force component. The horizontal component may be used to keep the panels together, forcing the panels towards each other, to improve the connection and the waterproof properties of the connection between the panels. The second locking element may be a recess comprising an upper portion and an adjoining lower portion, wherein the lower portion comprises an inclined locking surface, in order to co-act with the first locking element. The inclined surfaces further have the advantage, for instance over rounded surfaces, that they are relatively easy to make or mill, and that it is relatively easy to allow relatively large contact surface between the two to spread out locking forces in coupled panels. Preferably each inclined locking surface is a plane defining surface (planar surface), which plane forms a crease, or kink with the curved upper portion of the corresponding locking element. Said plane is preferably positioned in parallel with the planed formed by the inclined contact surface of the panel. For a smooth guidance it is preferred that for the upward tongue: the outside of the upward tongue extends vertically down towards and up to the outward bulge. The intersection of the upper portion of the outward bulge and the vertical outside of the upward tongue comprises a crease or kink. Said outward bulge consists preferably of a curved upper portion which curve gradually flattens near the lower area of the upper portion towards substantially vertical. The upper portions extends downwards to the lower portion, which lower portion consists of a plane inclined locking surface. The inclined locking surface forming a crease or kink with the flattened lower area of the upper portion of the outward bulge. The recess in the downward flank is preferably complementary (form-fitting) to the outward bulge and thus it is preferred that the upward flank comprises a vertical outside part which extends from the upper surface of the downward groove to and up to the recess. The inward recess comprises a curved upper portion which curve gradually flattens near the lower area of the upper portion towards preferably substantially vertical. The inclined locking surface forming a crease or kink with the flattened lower area of the upper portion of the recess. Said inclined locking surfaces have substantially the same inclination angle with respect to a vertical plane. Preferably, in coupled condition of adjacent panels, the upper portions of the first locking element and the second locking element are entirely spaced apart. This typically results in the situation that, in coupled condition of adjacent panels, the outward bulge and the recess solely co-act with each other via the inclined locking surfaces. In this manner, the functionality and effect of the inclined locking surfaces can be secured in an improved manner. Preferably, in coupled condition of adjacent panels, solely a part of the inclined locking surface of the lower portion of the outward bulge co-acts with solely a part of the inclined locking surface of lower portion of the recess. Preferably, the length of the inclined locking surface of the lower portion of the outward bulge is larger, preferably at least 1.5 times larger, than the inclined locking surface of the lower portion of the recess.

Preferably, the upper outside portion is preferably substantially vertical and defines an outer vertical plane, wherein at least a part the first locking element protrudes from the outer vertical plane at least partially, preferably maximally 2 mm, more preferably maximally 1 mm, in horizontal direction. The outer vertical plane typically divides the upward tongue into an inner section directed towards the upward flank, and an outer section which comprises the first locking element, wherein the maximum width of the inner section is preferably at least 8 times, preferably at least 10 times, the maximum width of the outer section.

The first locking element and the second locking element are preferably located at a level below the level of the inclined contact surfaces (if applied) and/or the third and fourth locking elements (if applied) of the downward tongue and the upward flank. This typically reduces the extent of deformation of the coupling parts during the coupling process, which is in favour of the lifetime and reliability of the coupling parts. Preferably, the level of the inclined contact surfaces of the downward tongue and the upward flank is above the level of the highest point of the upward tongue. This is typically favourable to create a watertight barrier as close to the top surface of the panels as reasonably possible.

Preferably, at least a part of the upper portion of the outward bulge located at the outside of the upward tongue is positioned at a higher level than a level defined by the lowest point of the upward groove, and preferably, at least a part of the upper portion of the recess located at the downward flank is positioned at a higher level than a level defined by the lowest point of the upward groove. The inclined contact surfaces of said bulge and recess are preferably located below the lowest point of the upward groove. This typically facilitates the coupling process, but may also be favourable in order to uncouple interconnected panels by means of a downwardly oriented angling out movement of the panels with respect to each other. The upper portion may extend over a larger vertical section compared to the lower portion, to gradually guide panels into place. The upper portion typically does not provide a vertical locking effect (because the upper portions of the outward bulge and recess are preferably spaced apart when coupled), such that the horizontal portions thereof are of less relevance compared to the lower portion, which typically does provide a vertical locking effect. The parts of the first and second locking element that are in contact, in coupled condition of the panels, are typically formed by the inclined locking surfaces of the locking elements, so by the lower portions. In coupled condition of the panels the upper portions of the first and second locking elements may be spaced apart at least partially. This spacing allows the upward tongue to move upwardly without being hindered by the downward flank, which upward movement may in turn be transferred and translated into a closing horizontal movement to improve the connection or locking of the panels, forcing the panels together. The outside of the upward tongue may comprise an upper outside portion and a lower outside portion, wherein the first locking element is arranged between the upper and lower outside portion, wherein the lower outside portion is arranged closer to the inside of the upward tongue compared to the upper outside portion. The upper outside portion may preferably be substantially vertical and defines an outer vertical plane, wherein the first locking element protrudes from the outer vertical plane at least partially, preferably maximally 2 mm. For example, the upper outside portion above the first locking element defines a vertical plane and the lower outside portion beneath the first locking element defines another vertical plane, which are parallel but offset, with the vertical plane of the lower outside portion being located closer to the upward flank. This difference creates a relative large distance between the panels at the intersection between the inclined locking surface of the upward tongue and the lower outside portion, which allows for a larger upward angling or rotational movement of the upward tongue and thus for a potential larger closing or tension force exerted by the locking elements to improve the connection and waterproof properties of the panels.

The lower outside portion may be substantially vertical and the inclined locking surface or the lower portion and the lower outside portion enclose an angle between 100 and 175 degrees, in particular between 100 and 150 degrees, more in particular between 110 and 135 degrees. Such angle has proven to provide the best combination of locking and guiding properties. The angle enclosed by the upper contact surfaces and the inclined contact surfaces and the angle enclosed by the lower outside portion and the inclined locking surface or the lower portion may be within 20 degrees difference, and is preferably the same. This allows for a relative easy manufacture wherein the same or similar tooling may be used to mill both elements from a panel.

An outermost portion of the first locking element may be arranged at a horizontal level which is lower compared to the upward groove. This way, during the downward motion of the panels during coupling, the widest or outermost portion of the first locking element is encountered relatively late, which facilitates coupling of two panels.

Preferably, below, and preferably adjoining, the upper contact surfaces of the downward tongue and the upward flank, the outside of the downward tongue comprises a third locking element and the upward flank comprises a fourth locking element, wherein, in coupled condition of adjacent panels, at least a part of the third locking element of said panel and at least a part of second locking element of an another panel are in contact to realize a locking effect, preferably a vertical locking effect, of the panels with respect to each other. Preferably, in coupled condition of adjacent panels, the upper contact surfaces define an inner vertical plane, wherein the third locking element and fourth locking element are positioned at the same, and more preferably single, side of said inner vertical plane facing away from the upward tongue. Preferably, the third locking element and the fourth locking element extend maximally 1 mm, preferably maximally 0.5 mm, more preferably maximally 0.2 mm, in horizontal direction with respect to said inner vertical plane. Each of the third locking element and fourth locking element may comprise a bulge and/or recess, wherein, preferably, the third locking element comprises a bulge, and wherein the fourth locking element comprises a recess.

Preferably, the level of the third locking element and the fourth locking element is above the level of the highest point of the upward tongue, which reduces material deformation and hence material stress during coupling and uncoupling. Preferably, the first locking element and the second locking element are located at a level below the level of the third locking element and fourth locking element, which (also) reduces material deformation and hence material stress during coupling and uncoupling.

The outside of the downward tongue preferably comprises in between the upper contact surface and the third locking element of the downward tongue at least one recess, wherein, in coupled condition of adjacent panels, said recess is preferably positioned at a distance from the upper contact surface of the upward flank. Said recess allows for (locally) expanding or swelling of the material of the panel preventing disrupting or dislocating the coupling between two intercoupled panels. The recess also functions as an additional dust chamber preventing dust to interfere with the contact of the upper contact surfaces. The recess may be arranged between the upper contact surface of the downward tongue and the third locking element of the downward tongue, or at the transition of the upper contact surface and the third locking element.

Adjoining, and typically directly adjoining or directly below, the upper contact surfaces an inclined contact surface may be present. At the inclined surfaces the panels are in contact, to create a connection or seal between the panels. The inclination is preferably such that, looking at the downward tongue, the inclined surface extends outwardly and, looking at the upward flank, the inclined surface extends inwardly. The inclination angle makes it such that the downward tongue thus has a protruding portion and the upward flank has a recessed portion, which in coupled condition are in contact and thus provide a vertical locking effect. The inclination also creates a slight labyrinth, which improves the waterproof properties of the connection.

Preferably, the inclined contact surface of the downward tongue extends maximally 1 mm, preferably maximally 0.5 mm, more preferably maximally 0.2 mm, in horizontal direction with respect to an inner vertical plane defined by (a contact portion of) the upper contact surfaces of two panels in coupled condition. Preferably, the level of the inclined contact surfaces of the downward tongue and the upward flank is above the level of the highest point of the upward tongue. This reduces the material stress during the coupling process, which will be in favour of the reliability of the durability of the coupling of adjacent panels. Typically, the inclined contact surface of the downward tongue defines at least a part of the third locking element, and wherein the inclined contact surface of the upward flank defines at least a part of the fourth locking element.

Adjoining, and typically directly adjoining or directly below, the inclined contact surface the downward tongue may comprise an outer surface. This outer surface may for instance be the outermost surface of the downward tongue, or the surface of the outer tongue the furthest from the downward flank. Similarly adjoining, and typically directly adjoining or directly below, the inclined contact surface the upward flank comprises an inner surface. Between the inner surface and the outer surface, a space is present. This space aims to prevent that any force exerted on or by the panels results in pushing the panels together anywhere else than at the upper contact surfaces and/or inclined contact surfaces. If the inner and outer surfaces would be in contact, they could prevent the upper contact surfaces to contact, which would be detrimental to the waterproof properties of the connection. At the top, at the upper contact surfaces and the inclined contact surfaces, the aim is thus to create a connection between the panels, whereas below these contact surfaces the aim is to avoid such connection.

The upper contact surfaces may at least partially be vertical and define an inner vertical plane, wherein the inclined contact surface of the downward tongue extends beyond the inner vertical plane, preferably by maximally 1 mm in horizontal direction, and wherein the inclined contact surface of the upward flank lies inward compared to the inner vertical plane. Such configuration is such that the downward tongue locally protrudes from the inner vertical plane, and the upward flank is locally recessed, wherein in coupled condition the inclined contact surfaces may grip behind each other to create a vertical locking effect. By limiting the horizontal extent of the protrusion, the downward tongue can still be coupled with a downward or vertical motion whilst providing the vertical locking effect. A portion of the downward tongue may thus extend beyond the inner vertical plane, which portion may be elongated with a larger vertical portion compared to the horizontal portion, wherein preferably the vertical portion is at least 3 times the horizontal portion. This allows for a relatively small horizontal portion, such that the panels can still be connected with a vertical or downward motion.

A portion of the downward tongue may thus extend beyond the inner vertical plane, wherein said portion may be substantially trapezium-shaped or wedge-shaped. Such shape allows that the portion, when under any locking, coupling or other force in the plane of the panels, is wedged into the space provided in the upward flank while also providing a robust portion able to withstand forces, to create a tight connection between the panels. This in turn improves the waterproof properties of the connection between the panels.

The inclined contact surfaces may both be arranged outside and/or adjoining the inner vertical plane, and are preferably completely arranged outside the inner vertical plane or located entirely on one side of the inner vertical plane. This allows for a relative simple construction which provides a tight connection between two panels. Preferably the upper contact surfaces, which define the vertical plane, directly transition into the inclined contact surfaces. In such configuration the connection, of the contact surfaces continue from the upper contact surfaces to the inclined contact surfaces, increasing the uninterrupted surface thus improving the connection between the panels and the waterproof properties of the connection.

In coupled condition a bottom of the downward tongue may contact the upper side of the upward groove at a groove contact surface, and wherein a gap is present between the first and second coupling parts, extending from the inclined contact surfaces to the groove contact surface. Such gap may be used to collect for instance dust or shavings from the panels, potentially created during coupling of two panels. Additionally such gap aims to prevent that any force exerted on or by the panels results in pushing the panels together anywhere else than at the upper contact surfaces and/or inclined contact surfaces. The groove contact surface is preferably mainly horizontal, and allows for forces exerted on the panel, and in particular on the connection between two panels, typically in downward direction by stepping on the panel, to be transferred to the subfloor or surface beneath the panels. It is preferred that the upward groove and downward tongue are shaped such that the gap in between the groove contact surface and the outward surface of the bottom of the downward tongue spans over a gap width, which gap width extends over at least a quarter of the groove width, more preferably at least a third and even more preferably over half of the groove width. Said groove width is defined by defined by the smallest horizontal width in between outer surface of the upward tongue and the upward flank.

An upper surface of the upward tongue and an upper surface of the downward groove may, in coupled condition, be distanced from each other such that a gap is present between the two surfaces. Again, such gap aims to prevent that any force exerted on or by the panels results in pushing the panels together anywhere else than at the upper contact surfaces and/or inclined contact surfaces. An upward motion of the upward tongue may for instance result in a horizontal force which closes or tightens the connection between two panels, more in particular in so called closed groove locking connections. To allow this upward motion, the gap is provided between the upward tongue and the downward groove. The upper surface of the downward groove may for instance be formed by the bottom surface of a bridge portion connecting the downward tongue to the rest of the panel The upper contact surface and the inclined contact surface of the upward flank may mutually enclose a first angle, and the upper contact surface and the inclined contact surface of the downward tongue may mutually enclose a second angle, wherein the first and second angle are within 20 degrees difference. For example, the inclined contact surface of the upward flank may mutually enclose a first angle of 120 degrees, and the upper contact surface and the inclined contact surface of the downward tongue may mutually enclose a second angle of 125 degrees. The difference between the two angles is degrees which is within 20 degrees as it is less than 20 degrees. By creating a difference between the angles, a configuration maybe provided wherein a wedging action may be achieved, to increase locking forces and waterproof properties in the connection. Pushing or wedging the locking elements into each other may result in increase in the locking forces or connections in the panels.

Preferably, in coupled condition of adjacent panels, a space is present between at least a part of the outer surface of said panel and at least a part the inner surface of an adjacent panel. Preferably, the outside of the upward tongue comprises an upper outside portion which defines an outer vertical plane which divides the upward tongue into an inner section directed towards the upward flank, and an outer section which comprises the first locking element, wherein the maximum width of the inner section is at least 8 times, preferably at least 10 times, the maximum width of the outer section. This results in a limited effective width of the first locking element, which facilitates the coupling process and reduces the degree of material deformation during the coupling process, which is in favour of the reliability and durability of the coupling of interconnected panels.

The panels according to the invention are for example at least partially made from magnesium oxide, or are magnesium oxide based. The panel according to the invention may comprise: a core provided with an upper side and a lower side, a decorative top structure (or top section) affixed, either directly or indirectly on said upper side of the core, wherein said core comprises: at least one composite layer comprising: at least one magnesium oxide (magnesia) and/or magnesium hydroxide based composition, in particular a magnesia cement. Particles, in particular cellulose and/or silicone based particles, may be dispersed in said magnesia cement. Optionally one or more reinforcement layers, such as glass fibre layers, may embedded in said composite layer. The core composition may also comprise magnesium chloride leading to a magnesium oxychloride (MOC) cement, and/or magnesium sulphate leading to magnesium oxysulphate (MOS) cement.

It has been found that the application of a magnesium oxide and/or magnesium hydroxide based composition, and in particular a magnesia cement, including MOS and MOC, significantly improves the inflammability (incombustibility) of the decorative panel as such. Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. Moreover, magnesia cement is a relatively good insulating material, both thermally and electrically, which makes the panel in particularly suitable for flooring for radar stations and hospital operating rooms. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner. Moreover, an additional advantage of the decorative panel is that it is suitable both for indoor and outdoor use.

As already addressed, the magnesia cement is based upon magnesium oxide and/or magnesium hydroxide. The magnesia cement as such may be free of magnesium oxide, dependent on the further reactants used to produce the magnesia cement. Here, it is, for example, well imaginable that magnesia as reactant is converted into magnesium hydroxide during the production process of the magnesia cement. Hence, the magnesia cement as such may comprise magnesium hydroxide. Typically, the magnesia cement comprises water, in particular hydrated water. Water is used as normally binder to create a strong and coherent cement matrix.

The magnesia based composition, in particular the magnesia cement, may comprise magnesium chloride ($MgCl_2$). Typically, when magnesia (MgO) is mixed with magnesium chloride in an aqueous solution, a magnesia cement will be formed which comprises magnesium oxychloride (MOC). The bonding phases are $Mg(OH)_2$, $5Mg(OH)_2 \cdot MgCl_2 \cdot 8H_2O$ (5-form), $3Mg(OH)_2 \cdot MgCl_2 \cdot 8H_2O$ (3-form), and $Mg_2(OH)ClCO_3 \cdot 3H_2O$. The 5-form is the preferred phase, since this phase has superior mechanical properties. Related to other cement types, like Portland cement, MOC has superior properties. MOC does not need wet curing, has high fire resistance, low thermal conductivity, good resistance to abrasion. MOC cement can be used with different aggregates (additives) and fibres with good adherence resistance. It also can receive different kinds of surface treatments. MOC develops high compressive strength within 48 hours (e.g. 8,000-10,000 psi). Compressive strength gain occurs early during curing—48-hour strength will be at least 80% of ultimate strength. The compressive strength of MOC is preferably situated in between 40 and 100 N/mm2. The flexural tensile strength is preferably 10-17 N/mm2. The surface hardness of MOC is preferably 50-250 N/mm2. The E-Modulus is preferably 1-3 $10^4$ N/mm2. Flexural strength of MOC is relatively low but can be significantly improved by the addition of fibres, in particular cellulose based fibres. MOC is compatible with a wide variety of plastic fibres, mineral fibres (such as basalt fibres) and organic fibres such as bagasse, wood fibres, and hemp. MOC used in the panel according to the invention may be enriched by one or more of these fibre types. MOC is non-shrinking, abrasion and acceptably wear resistant, impact, indentation and scratch resistant. MOC is resistible to heat and freeze-thaw cycles and does not require air entrainment to improve durability. MOC has, moreover, excellent thermal conductivity, low electrical conductivity, and excellent bonding to a variety of substrates and additives, and has acceptable fire resistance properties. MOC is less preferred in case the panel is to be exposed to relatively extreme weather conditions (temperature and humidity), which affect both setting properties but also the magnesium oxychloride phase development. Over a period of time, atmospheric carbon dioxide will react with magnesium oxychloride to form a surface layer of $Mg_2(OH)ClCO_3 \cdot 3H_2O$. This layer serves to slow the leaching process. Eventually additional leaching results in the formation of hydromagnesite, $4MgO \cdot {}_3CO_3 \cdot 4H_2O$, which is insoluble and enables the cement to maintain structural integrity.

The magnesium based composition, and in particular the magnesia cement, may be based upon magnesium sulphate, in particular heptahydrate sulphate mineral epsomite ($MgSO_4 \cdot 7H_2O$). This latter salt is also known as Epsom salt. In aqueous solution MgO reacts with MgSO4, which leads to magnesium oxysulphate cement (MOS), which has very good binding properties. In MOS, 5Mg(OH)2·MgSO4·8H2O is the most commonly found chemical phase. Although MOS is not as strong as MOC, MOS is better suited for fire resistive uses, since MOS start to decompose at temperatures more than two times higher than MOC giving longer fire protection. Moreover, their products of decomposition at elevated temperatures are less noxious (sulphur dioxide) than those of oxychloride (hydrochloric acid) and, in addition, less corrosive. Furthermore, weather conditions (humidity, temperature, and wind) during application are not as critical with MOS as with MOC. The mechanical strength of MOS cement depends mainly on the type and relative content of the crystal phases in the cement. It has been found that four basic magnesium salts that can contribute to the mechanical strength of MOS cement exist in the ternary system $MgO—MgSO_4—H_2O$ at different temperatures between of 30 and 120 degrees Celsius $5Mg(OH)_2 \cdot MgSO_4 \cdot 3H_2O$ (513 phase), $3Mg(OH)_2 \cdot MgSO_4 \cdot 8H_2O$ (318 phase), $Mg(OH)_2 \cdot 2MgSO_4 \cdot 3H_2O$ (123 phase), and $Mg(OH)_2 \cdot MgSO_4 \cdot 5H_2O$ (115 phase). Normally, the 513 phase and 318 phase could only be obtained by curing cement under saturated steam condition when the molar ratio of MgO and MgSO4 was fixed at (approximately) 5:1. It has been found that the 318 phase is significantly contributing to the mechanical strength and is stable at room temperature, and is therefore preferred to be present in the MOS applied. This also applies to the 513 phase. The 513 phase typically has a (micro)structure comprising a needle-like structure. This can be verified by means of SEM analysis. The magnesium oxysulphate ($5Mg(OH)_2 \cdot MgSO4 \cdot 3H2O$) needles may be formed substantially uniform, and will typically have a length of 10-15 μm and a diameter of 0.4-1.0 μm. When it is referred to a needle-like structure, also a flaky-structure and/or a whisker-structure can be meant. In practice, it does not seem feasible to obtain MOS comprising more than 50% 513 or 318 phase, but by adjusting the crystal phase composition can be applied to improve the mechanical strength of MOS. Preferably, the magnesia cement comprises at least 10%, preferably at least 20% and more preferably at least 30% of the $5Mg(OH)_2 \cdot MgSO_4 \cdot {}_3H_2O$ (513-phase). This preferred embodiment will provide a magnesia cement having sufficient mechanical strength for use in the core layer of a floor panel.

The crystal phase of MOS is adjustable by modifying the MOS by using an organic acid, preferably citric acid and/or by phosphoric acid and/or phosphates. During this modification new MOS phases can obtained, which can be expressed by $5Mg(OH)_2 \cdot MgSO4 \cdot 5H2O$ (515 phase) and $Mg(OH)_2 \cdot MgSO_4 \cdot 7H_2O$ (517-phase). The 515 phase is obtainable by modification of the MOS by using citric acid. The 517 phase is obtainable by modification of the MOS by using phosphoric acid and/or phosphates ($H_3PO_4$, $KH_2PO_4$, $K_3PO_4$ and $K_2HPO_4$). These 515 phase and 517 phase can be determined by chemical element analysis, wherein SEM analysis proves that the microstructure both of the 515 phase and the 517 phase is a needle-like crystal, being insoluble in water. In particular, the compressive strength and water resistance of MOS can be improved by the additions of citric acid. Hence, it is preferred that MOS, if applied in the panel according to the invention, comprises $5Mg(OH)_2 \cdot MgSO4 \cdot 5H2O$ (515 phase) and/or $Mg(OH)_2 \cdot MgSO_4 \cdot 7H_2O$ (517-phase). As addressed above, adding phosphoric acid and phosphates can extend the setting time and improve the compressive strength and water resistance of MOS cement by changing the hydration process of MgO and the phase composition. Here, phosphoric acid or phosphates ionize in solution to form $H_2PO_4^-$, $HPO_4^{2-}$, and/or $PO_4^{3-}$, wherein these anions adsorb onto $[Mg(OH)(H_2O)^x]^+$ to inhibit the formation of $Mg(OH)_2$ and further promote the generation of a new magnesium subsulfate phase, leading to the compact structure, high mechanical strength and good water resistance of MOS cement. The improvement produced by adding phosphoric acid or phosphates to MOS cement follows the order of $H_3PO_4 = KH_2PO+ >> K_2HPO_4 >> K_3PO_4$. MOS has better volumetric stability, less shrinkage, better binding properties and lower corrosivity under a significantly wider range of weather conditions than MOC, and could therefore be preferred over MOS. The density of MOS typically varies from 350 to 650 kg/m3. The flexural tensile strength is preferably 1-7 N/mm2.

The magnesium cement composition preferably comprises one or more silicone based additives. Various silicone based additives can be used, including, but not limited to, silicone oils, neutral cure silicones, silanols, silanol fluids, silicone (micro)spheres, and mixtures and derivatives thereof. Silicone oils include liquid polymerized siloxanes with organic side chains, including, but not limited to, polymethylsiloxane and derivatives thereof. Neutral cure silicones include silicones that release alcohol or other volatile organic compounds (VOCs) as they cure. Other silicone based additives and/or siloxanes (e.g., siloxane polymers) can also be used, including, but not limited to, hydroxyl (or hydroxy) terminated siloxanes and/or siloxanes terminated with other reactive groups, acrylic siloxanes, urethane siloxanes, epoxy siloxanes, and mixtures and derivatives thereof. As detailed below, one or more cross-linkers (e.g., silicone based crosslinkers) can also be used. The viscosity of the one or more silicone based additives (e.g., silicone oil, neutral cure silicone, silanol fluid, siloxane polymers, etc.) may be about 100 cSt (at 25° C.), which is called low-viscous. In alternative embodiments, the viscosity of the one or more silicone based additives (e.g., silicone oil, neutral cure silicone, silanol fluid, siloxane polymers, etc.) is between about 20 cSt (25° C.) and about 2000 cSt (25° C.). In other embodiments, the viscosity of the one or more silicone based additives (e.g., silicone oil, neutral cure silicone, silanol fluid, siloxane polymers, etc.) is between about 100 cSt (25° C.) and about 1250 cSt (25° C.). In other embodiments, the viscosity of the one or more silicone based additives (e.g., silicone oil, neutral cure silicone, silanol fluid, siloxane polymers, etc.) is between about 250 cSt (25° C.) and 1000 cSt (25° C.). In yet other embodiments, the viscosity of the one or more silicone based additives (e.g., silicone oil, neutral cure silicone, silanol fluid, siloxane polymers, etc.) is between about 400 cSt (25° C.) and 800 cSt (25° C.). And in particular embodiments, the viscosity of the one or more silicone based additives (e.g., silicone oil, neutral cure silicone, silanol fluid, siloxane polymers, etc.) is between about 800 cSt (25° C.) and about 1250 cSt (25° C.). One or more silicone based additives having higher and/or lower viscosities can also be used. For example, in further embodiments, the viscosity of the one or more silicone based additives (e.g., silicone oil, neutral cure silicone, silanol fluid, siloxane polymers, etc.) is between about 20 cSt (25° C.) and about 200,000 (25° C.) cSt, between about 1,000 cSt (25° C.) and about 100,000 cSt (25° C.), or between about 80,000 cSt (25° C.) and about 150,000 cSt (25° C.). In other embodiments, the viscosity of the one or more silicone based additives (e.g., silicone oil, neutral cure silicone, silanol fluid, siloxane polymers, etc.) is between about 1,000 cSt (25° C.) and about 20,000 cSt (25° C.), between about 1,000 cSt (25° C.) and about 10,000 cSt (25° C.), between about 1,000 cSt (25° C.) and about 2,000 cSt (25° C.), or between about 10,000 cSt (25° C.) and about 20,000 cSt (25° C.). In yet other embodiments, the viscosity of the one or more silicone based additives (e.g., silicone oil, neutral cure silicone, silanol fluid, siloxane polymers, etc.) is between about 1,000 cSt (25° C.) and about 80,000 cSt (25° C.), between about 50,000 cSt (25° C.) and about 100,000 cSt (25° C.), or between about 80,000 cSt (25° C.) and about 200,000 cSt (25° C.). And in still further embodiments, the viscosity of the one or more silicone based additives (e.g., silicone oil, neutral cure silicone, silanol fluid, siloxane polymers, etc.) is between about 20 cSt (25° C.) and about 100 cSt (25° C.). Other viscosities can also be used as desired.

In a preferred embodiment, the magnesium cement composition, in particular the magnesium oxychloride cement composition, comprises a single type of silicone based additive. In other embodiments, a mixture of two or more types of silicone based additives are used. For example, in some embodiments, the magnesium oxychloride cement composition can include a mixture of one or more silicone oils and neutral cure silicones. In particular embodiments, the ratio of silicone oil to neutral cure silicone can be between about 1:5 and about 5:1, by weight. In other such embodiments, the ratio of silicone oil to neutral cure silicone can be between about 1:4 and about 4:1, by weight. In other such embodiments, the ratio of silicone oil to neutral cure silicone can be between about 1:3 and about 3:1, by weight. In yet other such embodiments, the ratio of silicone oil to neutral cure silicone can be between about 1:2 and about 2:1, by weight. In further such embodiments, the ratio of silicone oil to neutral cure silicone can be about 1:1, by weight.

It is imaginable that one or more crosslinkers are used in the magnesia cement. In some embodiments, the crosslinkers are silicone based crosslinkers. Exemplary crosslinkers include, but are not limited to, methyllrimethoxysilane, methyltriethoxysilane, methyltris (methylethylketoximino)silane and mixtures and derivatives thereof. Other crosslinkers (including other silicone based crosslinkers) can also be used. In some embodiments, the magnesium oxychloride cement composition comprises one or more silicone based additives (e.g., one or more silanols and/or silanol fluids) and one or more crosslinkers. The ratio of one or more silicone based additives (e.g., silanols and/or silanol fluids) to crosslinker can be between about 1:20 and about 20:1, by weight, between about 1:10 and about 10:1 by weight, or between about 1:1 and about 10:1, by weight.

The magnesium (oxychloride) cement compositions comprising one or more silicone based additives may exhibit reduced sensitivity to water as compared to traditional magnesium (oxychloride) cement compositions. Further, in some embodiments, the magnesium (oxychloride) cement compositions comprising one or more silicone based additives may exhibit little or no sensitivity to water. The magnesium (oxychloride) cement compositions comprising one or more silicone based additives can further exhibit hydrophobic and water resistant properties.

Also, the magnesium (oxychloride) cement compositions comprising one or more silicone based additives can exhibit improved curing characteristics. For example, magnesium (oxychloride) cement compositions cure to form various reaction products, including $3Mg(OH)_2 \cdot MgCl_2 \cdot 8H2O$ (phase 3) and $5Mg(OH)_2 \cdot MgCl_2 \cdot 8H_2O$ (phase 5) crystalline structures. In some situations, higher percentages of the $5Mg(OH)_2 \cdot MgCl_2 \cdot 8H_2O$ (phase 5) crystalline structure is preferred. In such situations, the addition of one or more silicone based additives to the magnesium oxychloride cement compositions can stabilize the curing process which can increase the percentage yield of $5Mg(OH)_2 \cdot MgCl_2 \cdot 8H2O$ (phase 5) crystalline structures. For example, in some embodiments, the magnesium oxychloride compositions comprising one or more silicone based additives can cure to form greater than 80% $5Mg(OH)_2 \cdot MgCl_2 \cdot 8H_2O$ (phase 5) crystalline structures. In other embodiments, the magnesium oxychloride compositions comprising one or more silicone based additives can cure to form greater than 85% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 90% 5Mg(OH)2·MgCl2·8H2O (phase 5) crystalline structures. In yet other embodiments, the magnesium oxychloride compositions comprising one or more silicone based additives can cure to form greater than 95% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 98% $5Mg(OH)_2 \cdot MgCl_2 \cdot 8H_2O$ (phase 5) crystalline structures. In yet other embodiments, the magnesium oxychloride compositions comprising one or more silicone based additives can cure to form about 100% $5Mg(OH)_2 \cdot MgCl_2 \cdot 8H_2O$ (phase 5) crystalline structures.

Furthermore, the magnesium (oxychloride) cement compositions comprising one or more silicone based additives can also exhibit increased strength and bonding characteristics. If desired, the magnesium (oxychloride) cement compositions comprising one or more silicone based additives can also be used to manufacture magnesium (oxychloride) cement or concrete structures that are relatively thin. For example, the magnesium (oxychloride) cement compositions comprising one or more silicone based additives can be used to manufacture cement or concrete structures or layers having thicknesses of less than 8 mm, preferably less than 6 mm.

For realizing the coupling between the coupling part, temporary deformation of the coupling part(s) may be desired and/or even required, as a result of which it is beneficial to mix magnesium oxide and/or magnesium hydroxide and/or magnesium chloride and/or magnesium sulphate with one or more silicone based additives, since this leads to an increased a degree of flexibility and/or elasticity. For example, in some embodiments, cement and concrete structures formed using the magnesium oxychloride cement compositions can bend or flex without cracking or breaking.

The magnesium (oxychloride) cement compositions comprising one or more silicone based additives can further comprise one or more additional additives. The additional additives can be used to enhance particular characteristics of the composition. For example, in some embodiments, the additional additives can be used to make the structures formed using the disclosed magnesium oxychloride cement compositions look like stone (e.g., granite, marble, sandstone, etc.). In particular embodiments, the additional additives can include one or more pigments or colorants. In other embodiments, the additional additives can include fibers, including, but not limited to, paper fibers, wood fibers, polymeric fibers, organic fibers, and fiberglass. The magnesium oxychloride cement compositions can also form structures that are UV stable, such that the colour and/or appearance is not subject to substantial fading from UV light over time. Other additives can also be included in the composition, including, but not limited to plasticizers (e.g., polycarboxylic acid plasticizers, polycarboxylate ether-based plasticizers, etc.), surfactants, water, and mixtures and combinations thereof. As indicated above, the magnesium oxychloride cement composition, if applied, can comprise magnesium oxide (MgO), aqueous magnesium chloride ($MgCl_2$ (aq)), and one or more silicone based additives.

Instead of aqueous magnesium chloride ($MgCl_2$) magnesium chloride ($MgCl_2$) powder can also be used. For example, magnesium chloride ($MgCl_2$) powder can be used in combination with an amount of water that would be equivalent or otherwise analogous to the addition of aqueous magnesium chloride ($MgCl_2$ (aq)).

In certain embodiments, the ratio of magnesium oxide (MgO) to aqueous magnesium chloride ($MgCl_2$ (aq)), if applied, in the magnesium oxychloride cement composition can vary. In some of such embodiments, the ratio of magnesium oxide (MgO) to aqueous magnesium chloride ($MgCl_2$ (aq)) is between about 0.3:1 and about 1.2:1, by weight. In other embodiments, the ratio of magnesium oxide (MgO) to aqueous magnesium chloride ($MgCl_2$ (aq)) is between about 0.4:1 and about 1.2:1, by weight. And in yet other embodiments, the ratio of magnesium oxide (MgO) to aqueous magnesium chloride ($MgCl_2$ (aq)) is between about 0.5:1 and about 1.2:1, by weight.

The aqueous magnesium chloride ($MgCl_2$ (aq)) can be described as (or otherwise derived from) a magnesium chloride brine solution. The aqueous magnesium chloride ($MgCl_2$ (aq)) (or magnesium chloride brine) can also include relatively small amounts of other compounds or substances, including but not limited to, magnesium sulphate, magnesium phosphate, hydrochloric acid, phosphoric acid, etcetera.

In a preferred embodiment the amount of the one or more (liquid) silicone based additives within the magnesium oxychloride cement composition can be defined as the ratio of silicone based additives to magnesium oxide (MgO). For example, in some embodiments, the weight ratio of silicone based additives to magnesium oxide (MgO), is between 0.06 and 0.6.

Preferably, It is also imaginable, and even favourable, to incorporate in the core layer at least one oil, such as linseed oil or silicon oil. This renders the magnesium based core layer and/or thermoplastic based core layer more flexibility and reduced risk of breakage. Instead of or in addition to oil it is also imaginable to incorporate in the core layer one or more water-soluble polymers or polycondensed (synthetic) resins, such as polycarboxylic acid. This leads to the advantage that during drying/curing/setting the panel will not shrink which prevents the formation of cracks, and moreover provides the core layer, after drying/curing/setting, a more hydrophobic character, which prevents penetration of water (moisture) during subsequent storage and use.

It is imaginable that the core layer comprises polycaprolactone (PCL). This biodegradable polymer is especially preferred as this has been found to be made to melt by the exothermic reaction of the reaction mixture. It has a melting point of ca. 60° C. The PCL may be low density or high density. The latter is especially preferred as it produces a stronger core layer. Instead of, or in addition to, other polymers may be used, preferably a polymer chosen from the group consisting of: other poly(lactic-co-glycolic acid) (PLGA), poly(lactic acid) (PLA), poly(glycolic acid) (PGA), the family of polyhydroxyalkanoates (PHA), polyethylene glycol (PEG), polypropylene glycol (PPG), polyesteramide (PEA), poly(lactic acid-co-caprolactone), poly (lactide-co-trimethylene carbonate), poly(sebacic acid-co-ricinoleic acid) and a combination thereof.

Alternatively, the panel, in particular the core layer, may at least partly be made of PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. Recycled PUR may be made based on recyclable polymers, such as based on recyclable PET. PET can be recycled chemically by using glycolysis or depolymerisation of PET into monomers or oligomers, and subsequently into polyurethane polyols in the end. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based. The core may be solid or foamed, or both in case the core is composed of a plurality of parts/layers.

It may be advantageous in case the core layer comprises porous granules, in particular porous ceramic granules. Preferably the granules have a plurality of micropores of an average diameter of from 1 micron to 10 micron, preferably from 4 to 5 micron. That is, the individual granules preferably have micropores. Preferably, the micropores are interconnecting. They are preferably not confined to the surface of the granules but are found substantially throughout the cross-section of the granules. Preferably, the size of the granules is from 200 micron to 900 micron, preferably 250 micron to 850 micron, especially 250 to 500 micron or 500 to 850 micron. Preferably, at least two different sizes of granules, most preferably two, are used. Preferably, small and/or large granules are used. The small granules may have a size range of 250 to 500 micron. Preferably the large granules have a diameter of 500 micron to 850 micron. The granules may each be substantially of the same size or of two or more predetermined sizes. Alternatively, two or more distinct size ranges may be used with a variety of different sized particles within each range. Preferably two different sizes or ranges of sizes are used. Preferably, the granules each comprise a plurality of microparticles, substantially each microparticle being partially fused to one or more adjacent microparticles to define a lattice defining the micropores. Each microparticle preferably has an average size of 1 micron to 10 micron, with an average of 4 to 5 micron. Preferably, the average size of the micropores is from 2 to 8 micron, most preferably 4 to 6 micron. The micropores may be irregular in shape. Accordingly, the size of the micropores, and indeed the midi-pores referred to below, are determined by adding the widest diameter of the pore to the narrowest diameter of the pore and dividing by 2. Preferably, the ceramic material is evenly distributed throughout a cross-section of the core layer, that is substantially without clumps of ceramic material forming. Preferably, the microparticles have an average size of at least 2 micron or 4 micron and/or less than 10 micron or less than 6 micron, most preferably 5 to 6 micron. This particle size range has been found to allow the controlled formation of the micropores.

The granules may also comprise a plurality of substantially spherical midi-pores having an average diameter of 10 to 100 micron. They substantially increase the total porosity of the ceramic material without compromising the mechanical strength of the materials. The midi-pores are preferably interconnected via a plurality of micropores. That is, the midi-pores may be in fluid connection with each other via micropores. The average porosity of the ceramic material itself is preferably at least 50%, more preferably greater than 60%, most preferably 70 to 75% average porosity. The ceramic material used to produce the granules may be any (non-toxic) ceramic known in the art, such as calcium phosphate and glass ceramics. The ceramic may be a silicate, though is preferably a calcium phosphate, especially [alpha]- or [beta]-tricalcium phosphate or hydroxyapatite, or mixtures thereof. Most preferably, the mixture is hydroxyapatite and [beta]-tricalcium phosphate, especially more than 50% w/w [beta]-tricalcium, most preferably 85% [beta]-tricalcium phosphate and 15% hydroxyapatite. Most preferably the material is 100% hydroxyapatite. Preferably the cement composition or dry premix comprises 15 to 30% by weight of granules of the total dry weight of the composition or premix.

The porous particles could lead to a lower average density of the core layer and hence to a reduction of weight which is favourable from an economic and handling point of view. Moreover, the presence of porous particles in the core layer typically leads to, at least some extent, an increased porosity of a porous top surface and bottom surface of the core layer, which is beneficial for attaching an additional layer to the top surface and/or bottom surface of the core layer, such as, for example, a primer layer, an (initially liquid) adhesive layer, or another decorative or functional layer. Often, these layers are initially applied in a liquid state, wherein the pores allow the liquid substance to be sucked up (to permeate) into the pores, which increases the contact surface area between the layers and hence improves the bonding strength between said layers.

The panels may comprise a layered structure, comprising for instance a central core (or core layer) and at least one decorative top section, directly or indirectly affixed to said core layer, or integrated with said core layer, wherein the top section defines a top surface of the panel. The top section preferably comprises at least one decorative layer affixed, either directly or indirectly, to an upper surface of the core layer. The decorative layer may be a printed layer, such as a printed PVC layer, a printed PU layer or a printed paper layer, and/or may be covered by at least one protective (top) layer covering said decorative layer. The protective layer also makes part of the decorative top section. The presence of a print layer and/or a protective layer could prevent the tile to be damaged by scratching and/or due to environmental factors such as UV/moisture and/or wear and tear. The print layer may be formed by a film onto which a decorative print is applied, wherein the film is affixed onto the substrate layer and/or an intermediate layer, such as a primer layer, situated in between the substrate layer and the decorative layer. The print layer may also be formed by at least one ink layer which is directly applied onto a top surface of the core layer, or onto a primer layer applied onto the substrate layer. The panel may comprise at least one wear layer affixed, either directly or indirectly, to an upper surface of the decorative layer. The wear layer also makes part of the decorative top section. Each panel may comprise at least one lacquer layer affixed, either directly or indirectly, to an upper surface of the decorative layer, preferably to an upper surface of the wear layer.

The lower side (rear side) of the core (layer(s)) may also constitute the lower side (rear side) of the panel as such. However, it is thinkable, and it may even be preferable, that the panel comprises a backing layer, either directly or indirectly, affixed to said lower said of the core. Typically, the backing layer acts as balancing layer in order to stabilize the shape, in particular the flatness, of the panel as such. Moreover, the backing layer typically contributes to the sound dampening properties of the panel as such. As the backing layer is typically a closed layer, the application of the backing layer to the lower side of the core will cover the core grooves at least partially, and preferably entirely. Here, the length of each core groove is preferably smaller than the length of said backing layer. The backing layer may be provided with cut-out portions, wherein at least a part of said cut-out portions overlap with at least one core groove. The at least one backing layer is preferably at least partially made of a flexible material, preferably an elastomer. The thickness of the backing layer typically varies from about 0.1 to 2.5 mm. Non-limiting examples of materials of which the backing layer can be at least partially composed are polyethylene, cork, polyurethane, polyvinylchloride, and ethylene-vinyl acetate. Optionally, the backing layer comprises one or more additives, such as fillers (like chalk), dyes, resins and/or one of more plasticizers. In a particular embodiment, the backing layer is at least partially made of a composite of ground (or shaved) cork particles bound by resin. Instead of cork other tree related products, such as wood, may be used. The thickness of a polyethylene backing layer is for example typically 2 mm or smaller. The backing layer may either be solid or foamed. A foamed backing layer may further improve the sound dampening properties. A solid backing layer may improve the desired balancing effect and stability of the panel.

The inside of the upward tongue and the inside of the downward tongue may be in contact in coupled condition, to transfer forces between them, in particular from the upward tongue to the downward tongue. The insides of the tongues may be in contact at tongue contact surfaces, wherein the tongue contact surfaces may be inclined. The inclination may be such that at least a portion of the inside of the upward tongue is inclined towards the flank, such that a tangent line from the tongue contact surface intersects with the inner vertical plane above the tongue contact surface. Alternatively the inclination may be such that at least a portion of the inside of the tongue is inclined away from the upward flank, such that a tangent line from the tongue contact surface intersects with the inner vertical plane below the tongue contact surface. These are closed groove and open groove systems respectively. Closed groove systems provide for an improved locking, but are more difficult to couple, whereas open groove systems are easier to couple but do not provide the additional vertical locking of a closed groove system.

The first and second coupling parts are arranged on opposite sides of the panel. The panel is for instance rectangular or parallelogrammatic and/or elongated, and the first and second coupling parts may be arranged on both opposite sides (so on all four sides) of such panel. It is also possible to provide the first and second coupling parts on one pair of opposite sides only, and provide other coupling parts, such as angling down coupling parts with a sideward tongue and a sideward groove on the other pair of opposite sides.

The invention further relates to a covering, in particular a floor covering, comprising multiple interconnected panels according to any of the present invention.

BRIEF DESCRIPTION OF THE DRAWINGS

The invention will now be elucidated on the basis of non-limitative exemplary embodiments which are illustrated in the following figures. Corresponding elements are denoted in the figures by corresponding reference numbers. In the figures.

DESCRIPTION OF THE INVENTION

Figure 1:
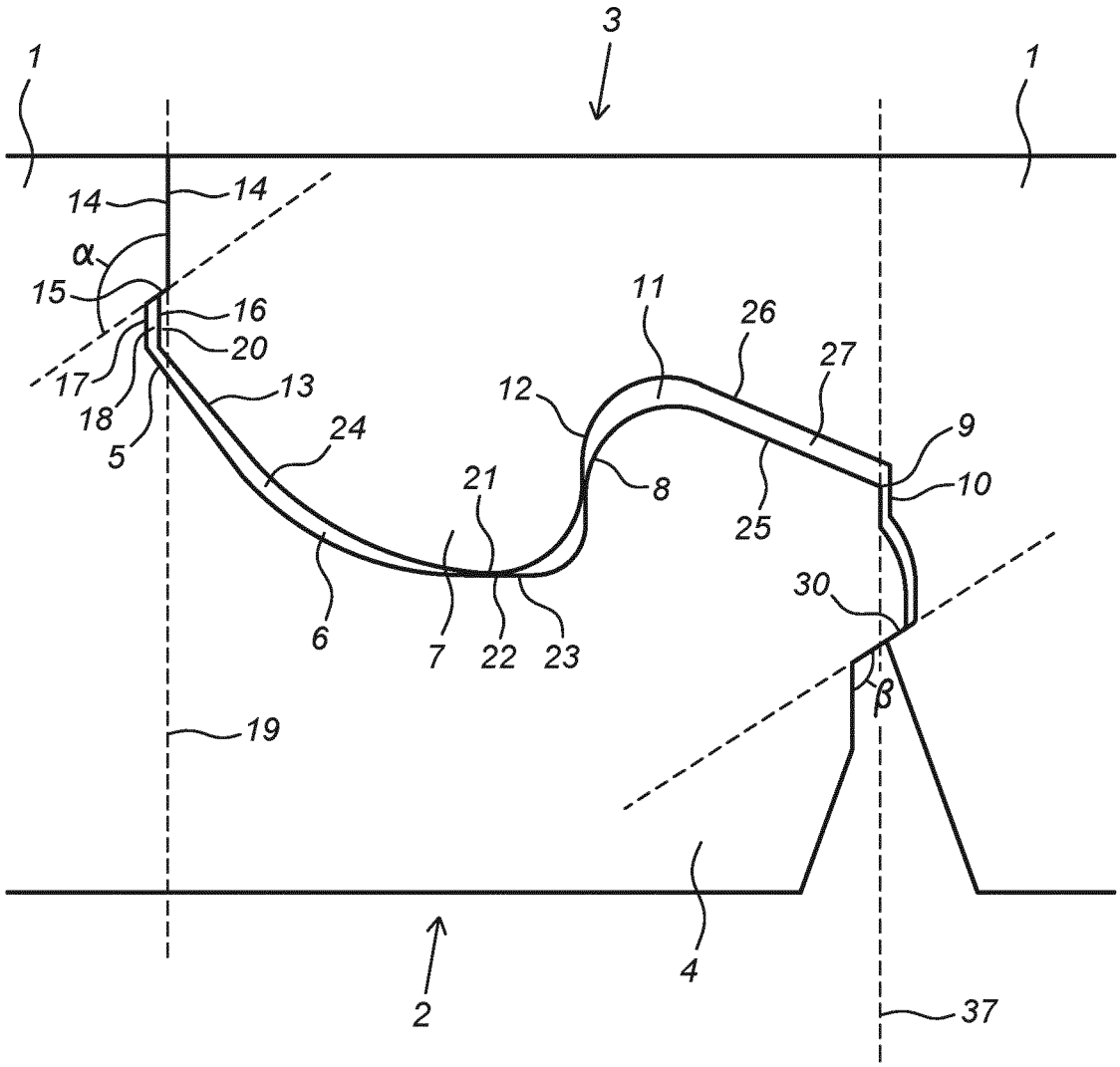
FIG. 1 schematically shows two interconnected panels with first and second coupling parts according to the present invention.

FIG. 1 shows a floor panel (1), comprising a first coupling part (2) and a second coupling part (3) in coupled condition. The first coupling part (2) comprises an upward tongue (4), an upward flank (5) lying at a distance from the upward tongue (4) and an upward groove (6) formed in between the upward tongue (4) and the upward flank (5), wherein the upward groove (6) adapted the downward tongue (7) of a second coupling part (3) of another panel (1). The side of the upward tongue (4) facing towards the upward flank is the inside (8) of the upward tongue (4) and the side of the upward tongue (4) facing away from the upward flank (5) is the outside (9) of the upward tongue (4).

The second coupling part (3) comprises a downward tongue (7), a downward flank (10) lying at a distance from the downward tongue (7), and a downward groove (11) formed in between the downward tongue (7) and the downward flank (10). The side of the downward tongue (7) facing towards the downward flank (10) is the inside (12) of the downward tongue (7) and the side of the downward tongue (7) facing away from the downward flank (10) is the outside (13) of the downward tongue (7).

The outside (13) of the downward tongue (7) and the upward flank (5) both comprise an upper contact surface (14) at the top of the panel (1), which upper contact surfaces (14) are in contact extend vertically. Adjoining the upper contact surfaces (14) both the downward tongue (7) and the upward flank (5) comprise an inclined contact surface (15), which inclined contact surfaces (15) are in contact, wherein the upper contact surfaces (14) on the one hand, and the inclined contact surfaces (15) of the upward flank (5) and/or the outside (13) of the downward tongue (7) on the other hand preferably mutually enclose an angle (a) of approximately 125 degrees. The upper contact surface (14) and the inclined contact surface (15) of the upward flank (5) mutually enclose a first angle of about 125 degrees, and the upper contact surface (14) and the inclined contact surface (15) of the downward tongue (7) mutually enclose a second angle of about 125 degrees.

Adjoining the inclined contact surface (15) the downward tongue (7) comprises an outer surface (16), and adjoining the inclined contact surface (15) the upward flank (5) comprises an inner surface (17), wherein the outer (16) and inner (17) surface are parallel and vertical. Between the outer surface (16) and the inner surface (17) a space (18) is present.

The upper contact surfaces (14) define an inner vertical plane (19), wherein the inclined contact surface (15) of the downward tongue (7) extends beyond the inner vertical plane (19) the inclined contact surface (15) of the upward flank (5) lies inward compared to the inner vertical plane (19). A portion (20) of the downward tongue (7) extends beyond the inner vertical plane (19), wherein said portion (20) is substantially trapezium-shaped or wedge-shaped. The inclined contact surfaces (15) are both arranged completely outside and adjoining the inner vertical plane (19). The portion (20) is elongated with a larger vertical portion compared to the horizontal portion.

The bottom (21) of the downward tongue (7) contacts the upper side (22) of the upward groove (6) at a groove contact surface (23), wherein a gap (24) is present between the first (2) and second (3) coupling parts, extending from the inclined contact surfaces (15) to the groove contact surface (23). Additionally the upper surface (25) of the upward tongue (4) and the upper surface (26) of the downward groove (11), are distanced from each other such that a gap (27) is present between the two surfaces (25, 26).

The outside (9) of the upward tongue (4) comprises a first locking element (28), in the form of an outward bulge and the downward flank (10) is provided with a second locking element (29), in the form of a recess, wherein the first (28) and at least a part of second (29) locking element are in contact, and form a locking element surface (30).

Figure 2:
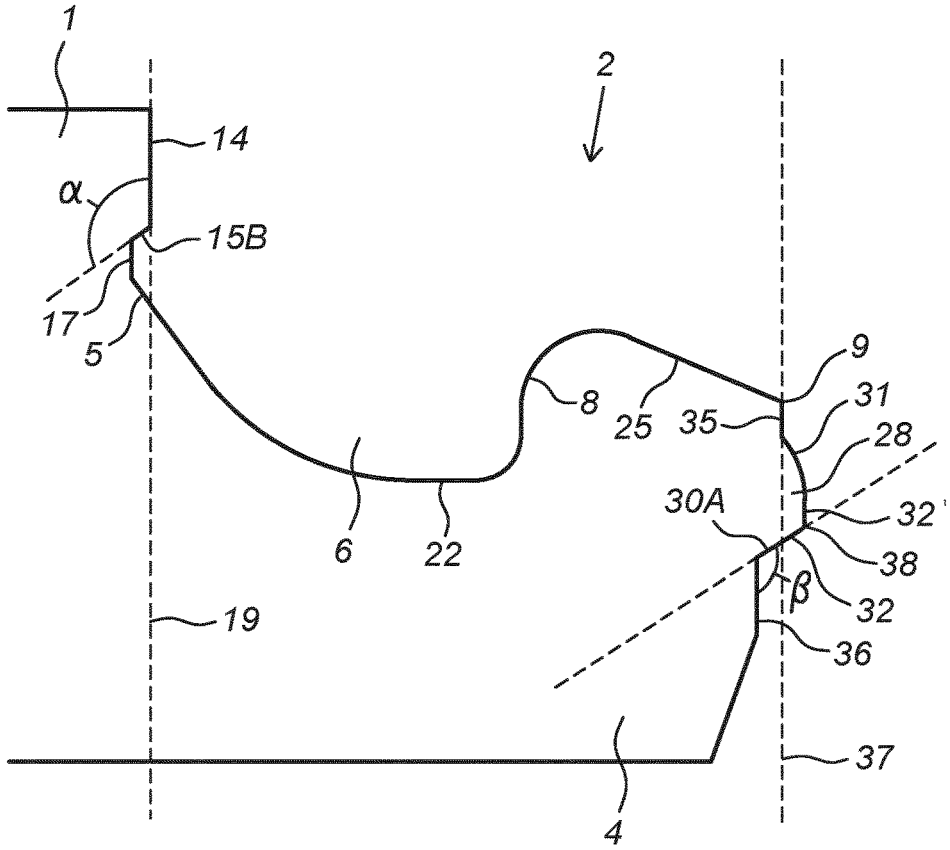
FIG. 2 schematically shows a first coupling part of a panel according to the present invention and FIG. 1.
Figure 3:
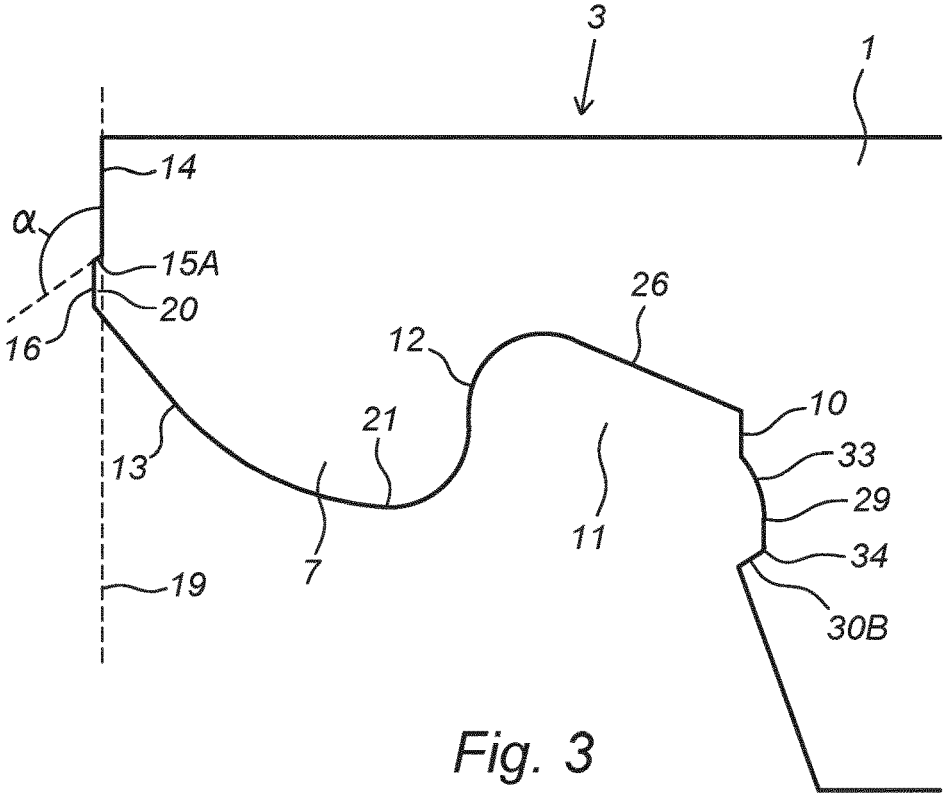
FIG. 3 schematically shows a second coupling part of a panel according to the present invention and FIG. 1.

FIGS. 2 and 3 show the first and second coupling parts individually. The outside of the outward bulge (28) comprises an upper portion (31) and an adjoining lower portion (32), wherein the lower portion (32) comprises an inclined locking surface (30*a*) and the upper portion (31) comprises a curved, guiding surface (32'). The recess (29) comprises an upper portion (33) and an adjoining lower portion (34), wherein the lower portion comprises an inclined locking surface (30B). The upper portion (31, 33) extends over a larger vertical section compared to the lower portion (32, 34).

The parts of the first (28) and second (29) locking element that are in contact are the inclined locking surfaces (30, 30A, 30B) of the locking elements (28, 29) and the upper portions (31, 33) of the first (28) and second (29) locking elements are spaced apart at least partially.

The outside (9) of the upward tongue (7) comprises an upper outside portion (35), and a lower outside portion (36), wherein the first locking element (28) is arranged between the upper (35) and lower outside portion (36). The lower outside portion (36) is arranged closer to the inside (8) of the upward tongue (4) compared to the upper outside portion (35).

The upper outside portion (35) is substantially vertical and defines an outer vertical plane (37), wherein the first locking element (28) protrudes from the outer vertical plane (37). The lower outside portion (36) is substantially vertical and the inclined locking surface (30A) or the lower portion (32) and the lower outside portion (36) enclose an angle ($\beta$) between 100 and 175 degrees. The angle ($\alpha$) enclosed by the upper contact surfaces and the inclined contact surfaces and the angle ($\beta$) enclosed by the lower outside portion (36) and the inclined locking surface (30A) or the lower portion (32) is about the same.

An outermost portion (38) of the first locking element (28) is arranged at a horizontal level which is lower compared to the upward groove (6).

Figure 4:
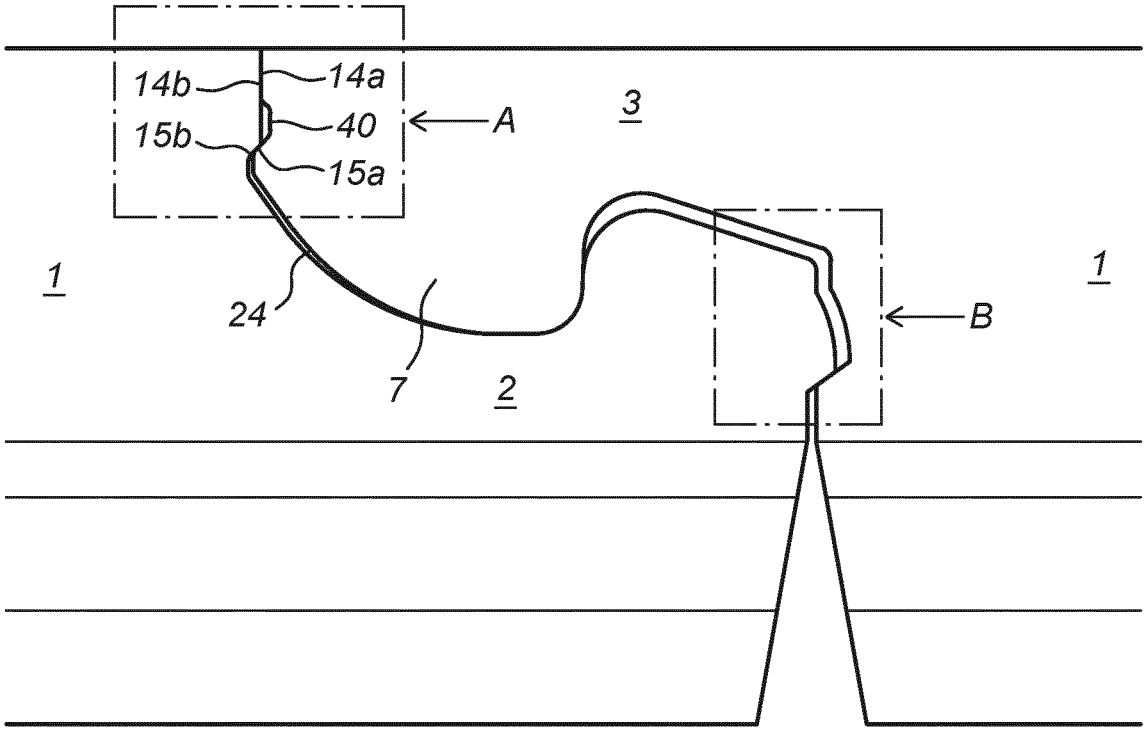
FIG. 4 schematically shows an embodiment of two interconnected panels with first and second coupling parts according to the present invention.

FIG. 4 schematically shows an embodiment of two interconnected panels (1) with first and second coupling parts according to the present invention. The panels (1) comprising a first coupling part (2) and a second coupling part (3) in coupled condition. The shown embodiment comprises all features as shown in FIG. 1 and further comprises a recess (40) positioned below the upper contact surface (14*a*) of the second coupling part (3). The recess (40) comprises an upper inclined surface and a lower inclined surface. The lower inclined surface is aligned with the inclined contact surface (15*a*) of the downward tongue (7). The recess (40) may act as expansion chamber to allow the panel material to swell, e.g. upon exposure to heat and/or moisture, and moreover, reduces the contact surface area at the top seam in between two panels (1) which allows clamping forces to be more prominently present at the top seam in between said panels (1) to improve the water barrier properties of the panel coupling as such.

Figure 5:
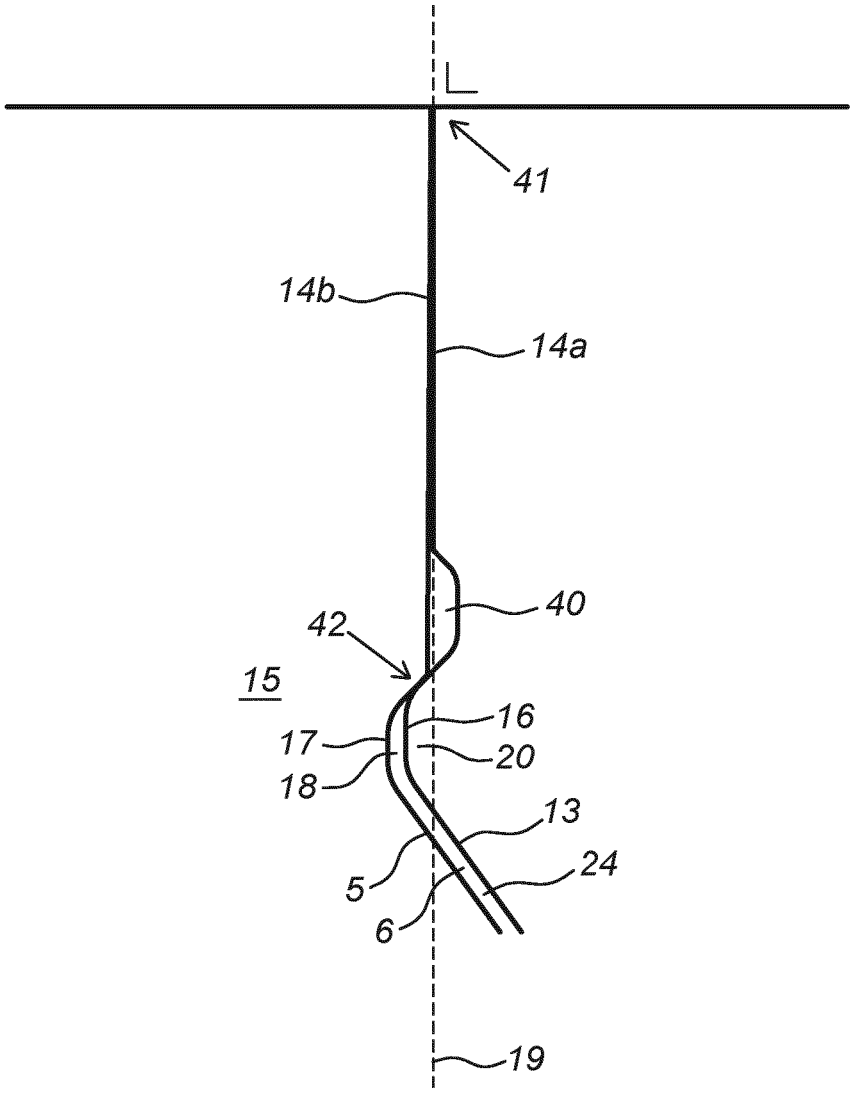
FIG. 5 schematically shows a detailed view of part A of the embodiment shown in FIG. 4.

FIG. 5 schematically shows a detailed view of part A of the embodiment shown in FIG. 4 around the upper contact surfaces of two interconnected panels. The figure shows two points or zones of contact (41, 42), wherein the engagement force (or clamping force) in this specific area of the coupling parts (2, 3) is higher than in other shown parts in this figures. These two points or zones of intensive contact (41, 42) leads to a significantly improved water barrier, and therefore a further improved watertight connection between said panels (1). The figure shows that the upper contact area 14*b* and 14*a* are not completely parallel but the upper contact area 14*b* is slightly inclined with respect to the opposite vertical upper contact area 14*a*, and more in particular (slightly) runs away from the vertical upper contact area 14*a* in downward direction. This does not necessarily means that the upper contact areas 14*a*, 14*b* will become separated from each other in downward direction, but does commonly lead to the effect that the contact between the upper portions of the upper contact areas 14*a*, 14*b*, is more intense than the contact between lower portions of the upper contact areas 14*a*, 14*b*.

It is conceivable that due to the locking force the area at or around the inclined contact surface 15*a* of the downward tongue is elastically or plastically deformed during engagement of adjacent inclined contact surfaces. Locally the area at or around the inclined contact surface 15*b* may also deform elastically or plastically.

Figure 6:
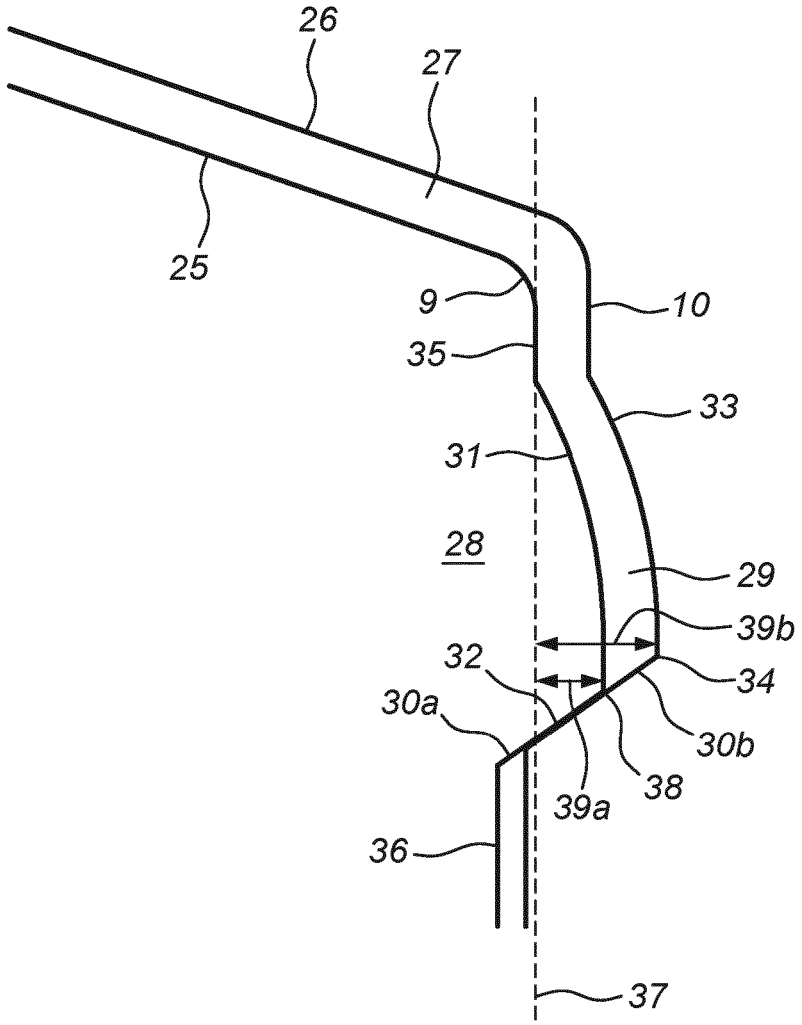
FIG. 6 schematically shows a detailed view of part B of the embodiment shown in FIG. 4.

FIG. 6 schematically shows a detailed view of part B of the embodiment shown in FIG. 4 of and around the interlocking elements (28,29) of two interconnected panels.

The upper outside portion (35) is substantially vertical and defines an outer vertical plane (37), wherein the first locking element (28) protrudes from the outer vertical plane (37). The distance (39*a*) between an outermost portion (38) of the first locking element (28) and the outer vertical plane (37) is substantially half of the distance (39*b*) between an outermost portion of the second locking element (29) and the vertical plane (37). The distance 39*b* is preferably less than 0.75 mm and the distance 39*a* is preferably less than 0.375 mm. In an embodiment the horizontal distance between the outer vertical plane (37) and the upper contact surface is a distance D. The distance 39*b* may be about 0.4 times that distance D and the distance 39*a* may be about 0.2 times that distance D.

The ordinal numbers used in this document, like "first", "second", "third", etcetera, are used only for identification purposes. The panels according to the invention may also be referred to as tiles. The core (layer) of the panel may also be referred to as base (layer), and may be composed of a plurality of sub-layers, which may e.g. include a reinforcement layer, such as a glass-fiber layer. The coupling parts may also be referred to as coupling profiles or as connecting profiles. By "complementary" coupling profiles is meant that these coupling profiles can cooperate with each other. However, to this end, the complementary coupling profiles do not necessarily have to have complementary forms. By locking in "vertical direction" is meant locking in a direction perpendicular to the plane of the panel. By locking in "horizontal direction" is meant locking in a direction perpendicular to the respective coupled edges of two panels and parallel to or falling together with the plane defined by the panels. In the context of this document, the expressions "foamed composite" and "foamed plastic material" (or "foam plastic material") are interchangeable, wherein in fact the foamed composite comprises a foamed mixture comprising at least one (thermo)plastic material and at least one filler (non-polymeric material).

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof.

The invention claimed is:

1. A panel, in particular a floor panel, comprising:

a. at least one first coupling part and at least one second coupling part arranged on opposite panel sides, wherein the first coupling part of said panel and the second coupling part of another panel are arranged to be coupled with a downward motion;

b. wherein the first coupling part comprises an upward tongue, at least one upward flank lying at a distance from the upward tongue and an upward groove formed in between the upward tongue and the upward flank, wherein the upward groove is adapted to receive at least a part of a downward tongue of a second coupling part of another panel, wherein a side of the upward tongue facing towards the upward flank is an inside of the upward tongue and a side of the upward tongue facing away from the upward flank is an outside of the upward tongue, wherein at least a part of the inside of the upward tongue is inclined towards the upward flank;

c. wherein the second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of another panel, wherein a side of the downward tongue facing towards the downward flank is an inside of the downward tongue and a side of the downward tongue facing away from the downward flank is an outside of the downward tongue, wherein at least a part of the inside of the downward tongue is inclined towards the downward flank;

d. wherein the outside of the downward tongue and the upward flank both comprise an upper contact surface near or towards the top of the panel, wherein at least one of said contact surfaces extends vertically at least partly, and wherein the upper contact surface of the outside of the downward tongue of said panel is configured to engage the upper contact surface of the upward flank of an adjacent panel, in coupled condition of said panels;

e. wherein the outside of the upward tongue comprises a first locking element comprising an outward bulge and wherein the downward flank is provided with a second locking element comprising a recess, wherein, in coupled condition of adjacent panels, at least a part of the first locking element of said panel and at least a part of second locking element of an another panel are in contact to realize a vertical locking effect of the panels with respect to each other;

f. wherein the outside of the outward bulge comprises an upper portion and an adjoining lower portion, wherein the lower portion comprises a planar inclined locking surface and the upper portion comprises a curved, guiding surface, wherein said inclined locking surface forms a crease with the curved upper portion;

g. wherein the recess comprises a curved upper portion and an adjoining lower portion, wherein the lower portion comprises a planar inclined locking surface wherein said inclined locking surface forms a crease with the curved upper portion;

h. and wherein, in coupled condition of adjacent panels, the inclined locking surface of the lower portion of the outward bulge and the inclined locking surface of the lower portion of the recess are in contact to realize said locking effect between the panels and wherein, in coupled condition of adjacent panels, the upper portions of the outward bulge of the first locking element and the recess of the second locking element are spaced apart at least partially;

i. wherein the outside of the upward tongue comprises an upper vertical outside portion, and a lower vertical outside portion, wherein the first locking element is arranged between the upper and lower vertical outside portion; and, j. wherein the inclined locking surface of the lower portion of the outward bulge and the inclined locking surface of the lower portion of the recess both enclose an angle with respect to the upper and/or lower vertical outside portion, said angle being between 100 and 175 degrees.

2. The panel according to claim 1, wherein the entire inside of the upward tongue is inclined towards the upward flank, and wherein the entire inside of the downward tongue is inclined towards the downward flank.

3. The panel according to claim 1, wherein, in coupled condition of adjacent panels, the upper portions of the first locking element and the second locking element are entirely spaced apart.

4. The panel according to claim 1, wherein, in coupled condition of adjacent panels, solely a part of the inclined locking surface of the lower portion of the outward bulge co-acts with solely a part of the inclined locking surface of the lower portion of the recess.

5. The panel according to claim 1, wherein at least a part of the upper portion of the outward bulge is positioned at a higher level than a level defined by the lowest point of the upward groove, and wherein at least a part of the upper portion of the recess is positioned at a higher level than a level defined by the lowest point of the upward groove.

6. The panel according to claim 1, wherein the length of the inclined locking surface of the lower portion of the outward bulge is larger than the inclined locking surface of the lower portion of the recess.

7. The panel according to claim 1, wherein the upper portion extends over a larger vertical section compared to the lower portion, wherein the height of the upper portion is at least three times the height of the lower portion.

8. The panel according to claim 1, wherein the lower outside portion is arranged closer to the inside of the upward tongue compared to the upper outside portion.

9. The panel according to claim 8, wherein the upper outside portion defines an outer vertical plane, wherein the first locking element protrudes from the outer vertical plane at least partially and maximally 2 mm in a horizontal direction.

10. The panel according to claim 1, wherein an outermost portion of the first locking element is arranged at a horizontal level which is lower compared to the upward groove.

11. The panel according to claim 1, wherein the upper contact surface of the downward tongue extends in a vertical direction, and wherein the upper contact surface of the upward flank is downwardly inclined in a direction away from the upward tongue, wherein the vertical upper contact surface of the downward tongue and the inclined upper contact surface of the upward flank mutually enclose an angle of between 0 and 2 degrees.

12. The panel according to claim 1, wherein adjoining the upper contact surfaces both the downward tongue and the upward flank comprise an inclined contact surface, wherein the inclined contact surface of the downward tongue of said panel is configured to engage the inclined contact surface of the upward flank of an adjacent panel, in coupled condition of said panels, wherein each vertical part of the upper contact surface and each adjoining inclining surface mutually enclose an angle ($\alpha$) between 100 and 175 degrees.

13. The panel according to claim 12, wherein the inclined contact surface of the downward tongue defines at least a part of the third locking element, and wherein the inclined contact surface of the upward flank defines at least a part of the fourth locking element.

14. The panel according to claim 12, wherein adjoining the inclined contact surface the downward tongue comprises an outer surface, situated below the inclined contact surface of the downward tongue, and wherein adjoining the inclined contact surface the upward flank comprises an inner surface, situated below the inclined contact surface of the upward flank, wherein the outer and inner surface run substantially parallel and extend at least partly in a vertical direction and/or are at least partly curved.

15. The panel according to claim 1, wherein, in coupled condition of adjacent panels, a space is present between at least a part of an outer surface of said panel and at least a part an inner surface of an adjacent panel.

16. The panel according to claim 1, wherein, in coupled condition of adjacent panels, a bottom of the downward tongue contacts the upper side of the upward groove at a groove contact surface, and wherein a gap is present between the first and second coupling parts, extending from the inclined contact surfaces to the groove contact surface.

17. The panel according to claim 1, wherein, in coupled condition of adjacent panels, a bottom of the downward tongue contacts the upper side of the upward groove at a substantially horizontal, groove contact surface, and wherein gaps are present between the first and second coupling parts at both sides of said groove contact surface.

18. The panel according to claim 1, wherein an upper surface of the upward tongue and an upper surface of the downward groove, in coupled condition, are at least partly distanced from each other such that a gap is present between the two upper surfaces.

19. The panel according to claim 1, wherein the outside of the upward tongue comprises an upper outside portion which defines an outer vertical plane which divides the upward tongue into an inner section directed towards the upward flank, and an outer section which comprises the first locking element, wherein the maximum width of the inner section is at least 8 times the maximum width of the outer section.

20. The panel according to claim 1, wherein the panel comprises at least one third coupling part and at least one fourth coupling part arranged on another pair of opposite sides of the panel, wherein the third coupling part of said panel and the fourth coupling part of another panel are arranged to be coupled by means of an angling down motion.

21. The panel according to claim 20, wherein the third coupling part comprises:

a sideward tongue extending in a direction substantially parallel to the upper side of the core, at least one second downward flank lying at a distance from the sideward tongue, and a second downward groove formed between the sideward tongue and the second downward flank, and wherein the fourth coupling part comprises:

a third groove configured for accommodating at least a part of the sideward tongue of the third coupling profile of an adjacent panel, said third groove being defined by an upper lip and a lower lip, wherein said lower lip is provided with an upward locking element, wherein the third coupling part and the fourth coupling part are configured such that two of such panels can be coupled to each other by means of a turning movement, wherein, in coupled condition: at least a part of the sideward tongue of a first panel is inserted into the third groove of an adjacent, second panel, and wherein at least a part of the upward locking element of said second panel is inserted into the second downward groove of said first panel.

22. The panel according to claim 1, wherein the panel is a decorative panel, comprising:

at least one core layer, and at least one decorative top section, directly or indirectly affixed to said core layer, wherein the top section defines a top surface of the panel, a plurality of side edges at least partially defined by said core layer and/or by side top section, which at least two opposing side edges are provided with the first coupling part and the second coupling part, respectively.

23. A covering, in particular a floor covering, comprising multiple interconnected panels according to claim 1.

* * * * *